US012631092B2

(12) United States Patent
Keyes et al.

(10) Patent No.: US 12,631,092 B2
(45) Date of Patent: May 19, 2026

(54) KINETIC ENERGY PERFORATING ROUND AND METHODS OF USE

(71) Applicant: Defiant Precision Technologies, LLC, Odessa, TX (US)

(72) Inventors: Cullen Craig Keyes, Hysham, MT (US); Ian Graham Janke, Parkland County (CA); Lawrence Gene Griffin, Morrison, CO (US)

(73) Assignee: Defiant Precision Technologies, LLC, Odessa, TX (US)

( * ) Notice: Subject to any disclaimer, the term of this patent is extended or adjusted under 35 U.S.C. 154(b) by 0 days.

(21) Appl. No.: 19/051,968

(22) Filed: Feb. 12, 2025

(65) Prior Publication Data

US 2025/0264008 A1 Aug. 21, 2025

Related U.S. Application Data

(60) Provisional application No. 63/554,050, filed on Feb. 15, 2024.

(51) Int. Cl.

| | |
|---|---|
| ***E21B 43/116*** | (2006.01) |
| ***E21B 43/11*** | (2006.01) |
| ***F42B 30/00*** | (2006.01) |

(52) U.S. Cl.

CPC ..... *E21B 43/116* (2013.01); *E21B 43/11* (2013.01); *F42B 30/00* (2013.01)

(58) Field of Classification Search

CPC .... E21B 43/116; E21B 43/119; E21B 43/117; E21B 43/11; E21B 31/002; E21B 7/007;

(Continued)

(56) References Cited

U.S. PATENT DOCUMENTS

| | | | |
|---|---|---|---|
| 2,565,789 | A | 8/1951 | Tow |
| 3,714,900 | A | 2/1973 | Feldmann |

(Continued)

FOREIGN PATENT DOCUMENTS

| | | | |
|---|---|---|---|
| CN | 103562493 | A | 2/2014 |
| CN | 208934668 | U | 6/2019 |

(Continued)

OTHER PUBLICATIONS

International Search Report and Written Opinion, mailed Jun. 9, 2025, from PCT Application No. PCT/US2025/015697, 13 pages.

(Continued)

*Primary Examiner* — Yong-Suk (Philip) Ro
(74) *Attorney, Agent, or Firm* — Workman Nydegger

(57) ABSTRACT

Perforation devices including gas supply structures and methods of utilizing the same. The perforation devices include a magazine, a barrel, an action, and the gas supply structure. The magazine is configured to contain a plurality of cartridges. The barrel extends between a breech, which is configured to receive a selected cartridge of the plurality of cartridges that includes a selected projectile, and a muzzle, which is configured, upon firing of the selected cartridge, to permit the selected projectile to exit the barrel at a muzzle velocity and with a muzzle trajectory. The action is configured to transfer the selected cartridge from the magazine to the breech of the barrel and to fire the selected cartridge. The gas supply structure is configured to provide a gas stream to the barrel and includes a surface gas source and a gas supply conduit extending between the surface gas source and the barrel.

7 Claims, 6 Drawing Sheets

(58) Field of Classification Search
CPC ..... E21C 37/005; F42B 1/02; F42B 1/028; F42B 1/032; F42B 3/08; F42B 12/76; F21B 30/00
See application file for complete search history.

(56) References Cited

U.S. PATENT DOCUMENTS

| | | | | |
|---|---|---|---|---|
| 4,123,975 | A | | 11/1978 | Mohaupt |
| 4,299,287 | A | * | 11/1981 | Vann ..... E21B 43/116 166/318 |
| 4,387,773 | A | | 6/1983 | McPhee |
| 4,651,649 | A | | 3/1987 | Nussbaum |
| 4,753,172 | A | * | 6/1988 | Katzmann ..... F42B 12/06 102/491 |
| 4,881,445 | A | | 11/1989 | Hayes |
| 4,970,960 | A | | 11/1990 | Feldmann |
| 5,182,419 | A | | 1/1993 | Burnette |
| 5,415,102 | A | | 5/1995 | White |
| 5,765,637 | A | | 6/1998 | Dietle et al. |
| 9,175,939 | B1 | | 11/2015 | Wilfong et al. |
| 10,577,129 | B1 | | 3/2020 | Poulsen |
| 10,591,263 | B2 | | 3/2020 | Brown et al. |
| 11,867,487 | B1 | | 1/2024 | Wach et al. |
| 2003/0110973 | A1 | | 6/2003 | Mutascio et al. |
| 2011/0094406 | A1 | | 4/2011 | Marya et al. |
| 2012/0247771 | A1 | | 10/2012 | Black et al. |
| 2017/0080498 | A1 | | 3/2017 | Burrow |
| 2018/0154446 | A1 | | 6/2018 | Brown et al. |
| 2019/0085665 | A1 | * | 3/2019 | Al-Gouhi ..... E21B 43/117 |
| 2019/0153828 | A1 | | 5/2019 | Tolman et al. |
| 2021/0310773 | A1 | * | 10/2021 | Johnson ..... F42B 3/08 |
| 2022/0252382 | A1 | | 8/2022 | Barrett et al. |
| 2023/0052273 | A1 | * | 2/2023 | Björkgren ..... F42B 1/028 |
| 2024/0210148 | A1 | * | 6/2024 | Gustafsson ..... F42B 1/032 |
| 2024/0310155 | A1 | | 9/2024 | Thuvander et al. |
| 2024/0360742 | A1 | | 10/2024 | Keyes et al. |
| 2025/0146389 | A1 | | 5/2025 | Keyes et al. |

FOREIGN PATENT DOCUMENTS

| | | | |
|---|---|---|---|
| JP | 03-233300 | A | 10/1991 |
| WO | 2019/103780 | A1 | 5/2019 |

OTHER PUBLICATIONS

International Search Report and Written Opinion received for PCT Patent Application No. PCT/US2025/015699, mailed on May 5, 2025, 10 pages.
International Search Report and Written Opinion received for PCT Patent Application No. PCT/US2025/015692, mailed on Jun. 10, 2025, 13 pages.
International Search Report and Written Opinion received for PCT Patent Application No. PCT/US2025/015697, mailed on Jun. 9, 2025, 13 pages.

* cited by examiner

KINETIC ENERGY PERFORATING ROUND AND METHODS OF USE

TECHNOLOGICAL FIELD OF THE DISCLOSURE

One or more example embodiments disclosed herein are directed to projectiles and associated components such as may be employed in downhole perforation operations. More specifically, example embodiments comprise a projectile comprising a kinetic energy perforating round, and a method for using the same.

BACKGROUND

Perforating is a process used to create holes in a well casing disposed in a wellbore. Typically, the holes, or perforations, are created using a perforation gun that fires a projectile of some kind. While conventional projectiles are effective in creating perforations, the size, quality, and shape, of the perforations are inconsistent and can vary widely from one perforation to another, even when the same type of projectile is used to create the various perforations. Such variations can cause problems, such as by inhibiting the free flow of hydrocarbons into a well bore. As another example, some processes, such as hydraulic fracturing, or frac'ing, may require the use of symmetric and uniform holes for optimal performance. However, conventional projectiles often create holes that are asymmetric.

BRIEF DESCRIPTION OF THE DRAWINGS

The appended drawings contain figures of various example embodiments to further illustrate and clarify the above and other aspects of example embodiments. It will be appreciated that these drawings depict only example embodiments and are not intended to limit the scope of this disclosure or of any claims. Example embodiments will be described and explained with additional specificity and detail through the use of the accompanying drawings.

ASPECTS OF SOME EXAMPLE EMBODIMENTS

Figure 1:
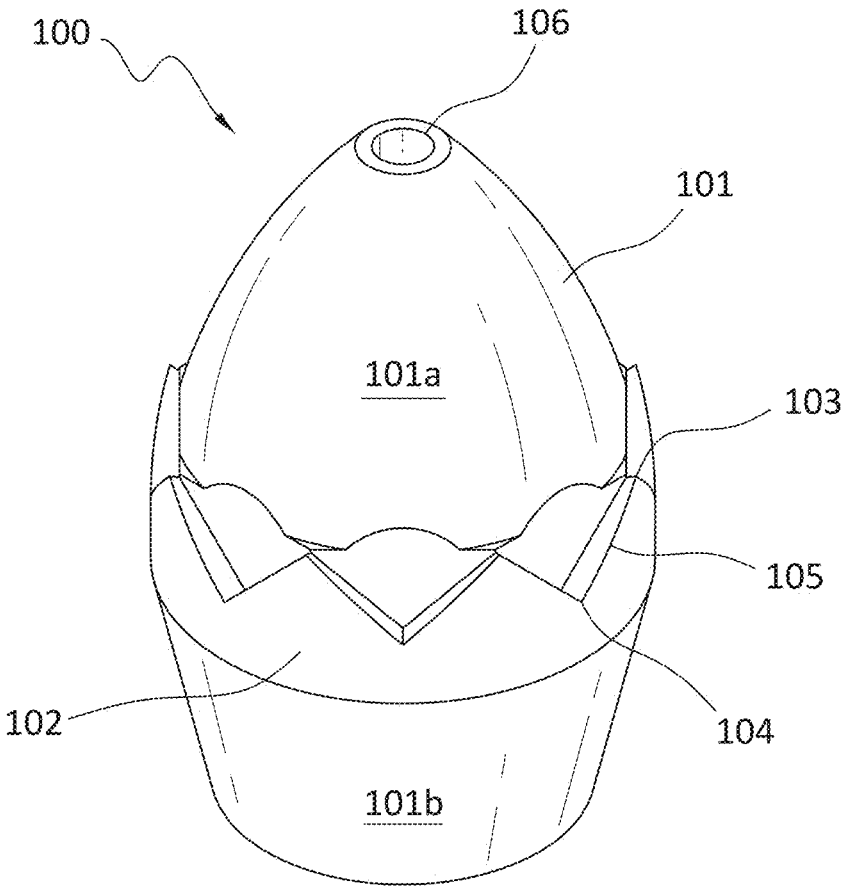
FIG. 1 is an isometric view of an example kinetic energy perforating round (KEPR), according to one embodiment.
Figure 2:
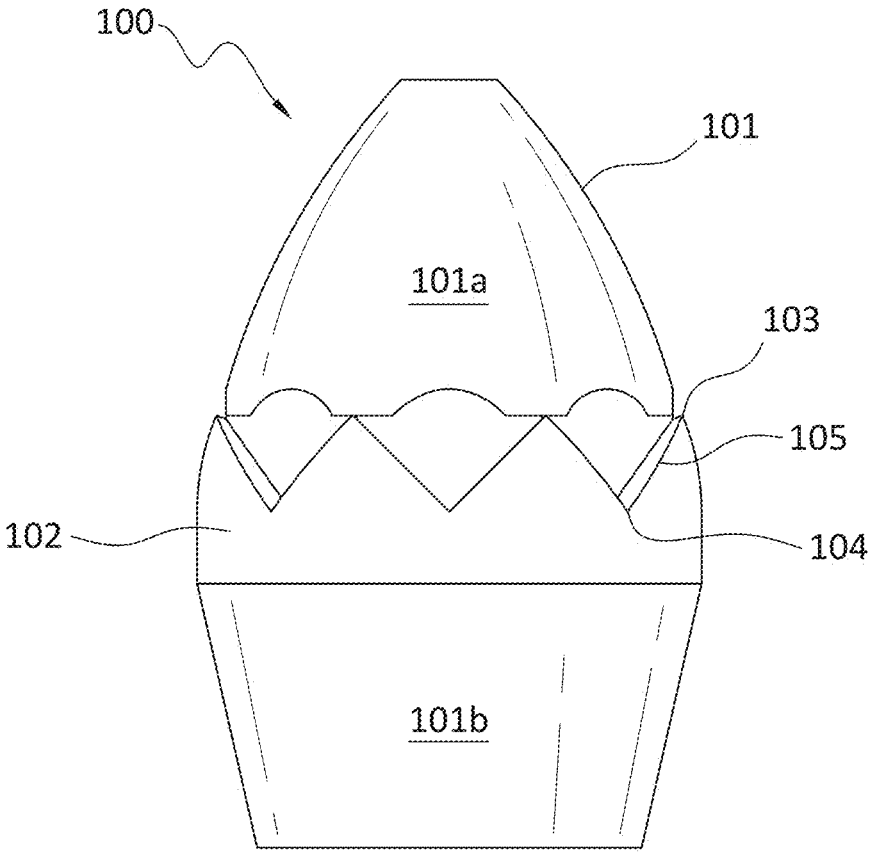
FIG. 2 is a side view of an example KEPR, according to one embodiment.
Figure 3:
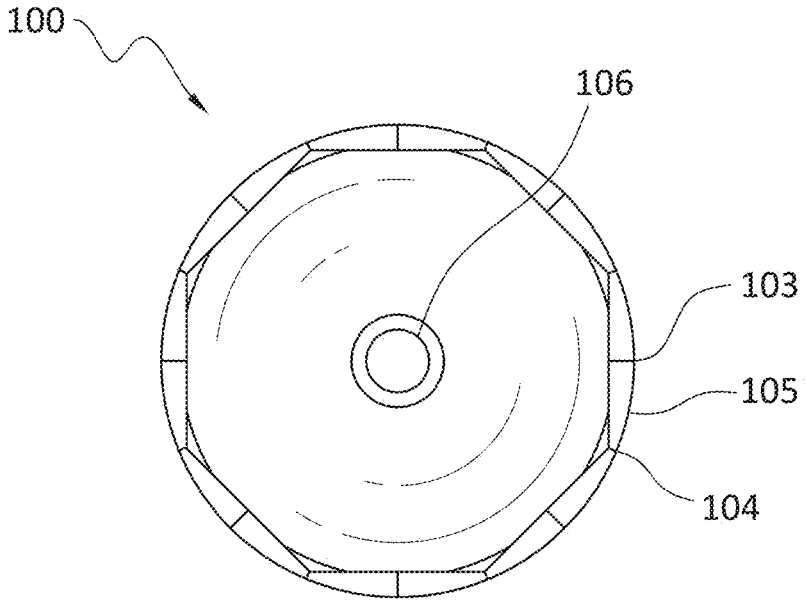
FIG. 3 is a top view of an example KEPR, according to one embodiment.
Figure 4:
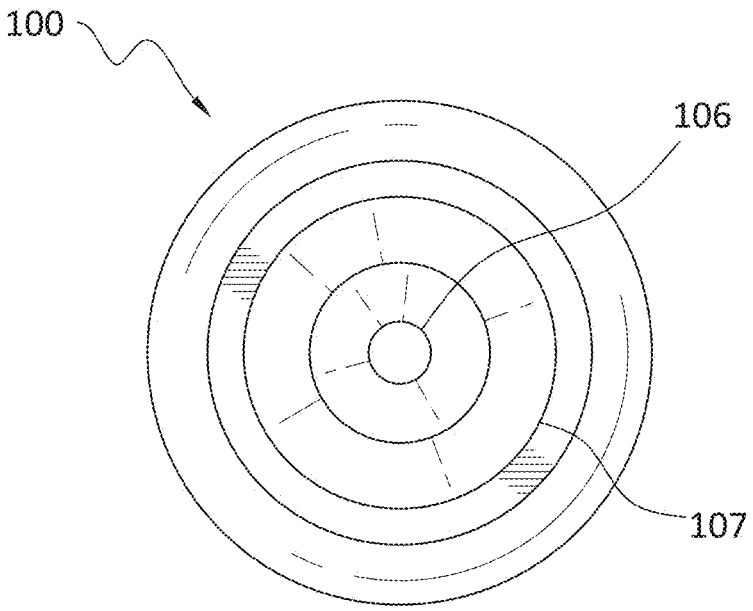
FIG. 4 is a bottom view of an example KEPR, according to one embodiment.
Figure 5:
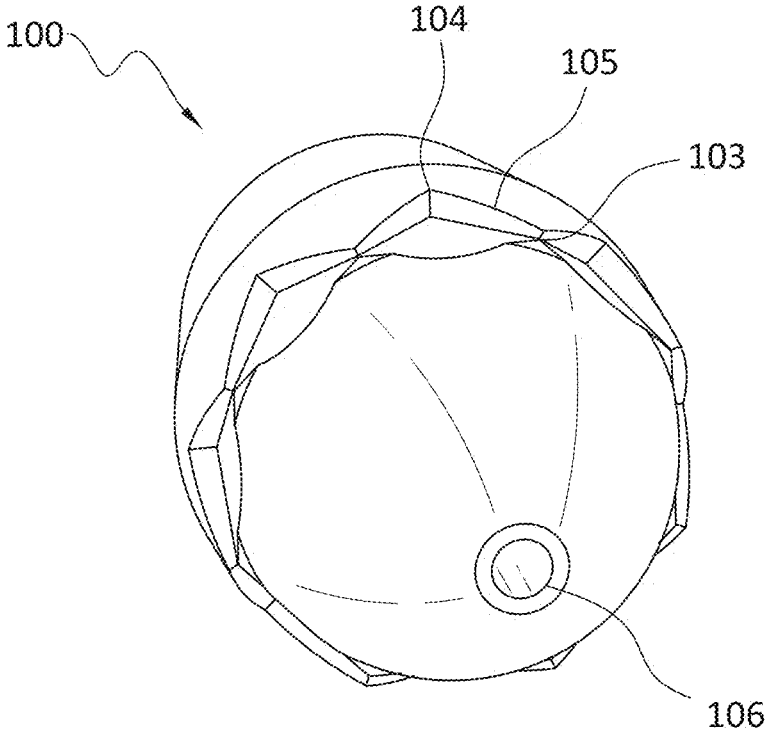
FIG. 5 is a top isometric view of an example KEPR, according to one embodiment.

One or more example embodiments disclosed herein are directed to projectiles and associated components such as may be employed in downhole perforation operations. More specifically, example embodiments comprise a projectile in the form of a kinetic energy perforating round (KEPR), and a method for using the same.

In one embodiment, a kinetic energy perforating round comprises a body having a circular cross section and defining an ignition housing entry port and ignition housing that are in communication with each other. A crown configuration is disposed radially about an outside diameter of the body, and the crown configuration defines a maximum outside diameter of the kinetic energy perforating round.

As will be apparent from this disclosure, example embodiments may be advantageous in various respects. For example, an embodiment may create a perforation that is symmetric in shape. Instances of an embodiment may create perforations that are consistent, from one to the next, in their size, quality, and shape. An embodiment may enable flows that are more consistent, reliable, and predictable, than flows obtained with conventional projectiles. Various other advantages of one or more embodiments will be apparent from this disclosure.

It should be noted that nothing herein should be construed as constituting an essential or indispensable element of any embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

DETAILED DESCRIPTION OF SOME EXAMPLE EMBODIMENTS

A. INTRODUCTION

As noted above, one or more example embodiments comprise a kinetic energy penetrating round (KEPR) that may be fired from a perforation gun, which may comprise a reusable perforation gun. An example KEPR may be able to penetrate a variety of structures and materials including, but not limited to, a steel well casing, concrete, and a geologic formation. In one example application, an embodiment of a KEPR may penetrate all of the foregoing structures after being fired from a perforation gun. In an embodiment, a perforation gun may carry, and fire, multiple KEPRs.

B. DISCUSSION

With attention now to the examples of FIGS. 1 through 6, details are provided concerning aspects of some example KEPRs, referenced in the Figures at 100, according to an embodiment. The embodiments disclosed in the Figures are presented by way of example and are not intended to limit the scope of this disclosure, or of any claims, in any way.

B.1 Kinetic Energy Perforating Round (KEPR)—Overview

B.1.1 KEPR structure overview

A KEPR 100 according to one embodiment may be configured to utilize kinetic energy, resulting from the ignition of one or more propellants for example, as one mechanism for perforating a confined target in a confined space, such as casing in a wellbore. The confined target may be confined by rock, cement, and/or concrete which may also be confined. The KEPR may be a single, homogeneous piece, crafted, such as by machining or casting for example, from a material chosen for its density and strength, such as tungsten or tool steel.

In an embodiment, the KEPR 100 comprises a crowned mid-section, as seen in FIG. 1 for example. In particular, the mid-section of an example KEPR 100 comprises a crown with peaks, valleys, and slopes. This configuration may act to concentrate the impact force, imposed by the KEPR 100 after being fired from a perforation gun or other apparatus, on specific points within a casing, wellbore, geologic formation and/or other structure(s), enhancing the perforating effect by concentrating energy on localized areas and may provide a perforating action along the diameter of the hole for repeatable precise geometries for the perforations.

With reference to the Figures, an example KEPR 100 may comprise a body 101 which may comprise, at an upper portion 101*a*, a generally conical shape, or a truncated tangent ogive shape. A lower portion 101*b* of the body 101 may be configured in a truncated cone shape that is sized and arranged to enable the KEPR 100 to interface with, such as by being received in, a non-discarding, grounding sabot, for example. Example embodiments of a "non-discarding, grounding sabot" are disclosed in United States Patent Application, entitled GROUNDING SABOT AND METHODS OF USE, filed the same day herewith, and incorporated herein in its entirety by this reference.

A crown configuration 102 may be disposed about a perimeter of the body 101, possibly at the portion of the body 101 where the diameter of the KEPR 100 is at a maximum. The crown configuration 102 may comprise a series of peaks 103 and valleys 104, as well as slopes 105 that extend from a peak 103 to an adjacent valley 104. The peaks 103 extend in a direction such that they are pointed towards a target when the KEPR 100 is positioned in a perf gun.

As shown, the width of the slopes 105 may vary, for example, from a maximum at a peak 103 to a minimum at a valley 104. The number of peaks 103, and valleys 104, is not limited to any particular value(s). It will be appreciated that as the numbers of peaks 103 and valleys 104 decrease, the size of the respective angles defined by the peaks 103 and valleys 104 will increase, and vice versa. Thus, the number of peaks 103 and valleys 104 in a given crown configuration 102 may vary from one KEPR 100 to another, based on the particular circumstances.

Figure 6:
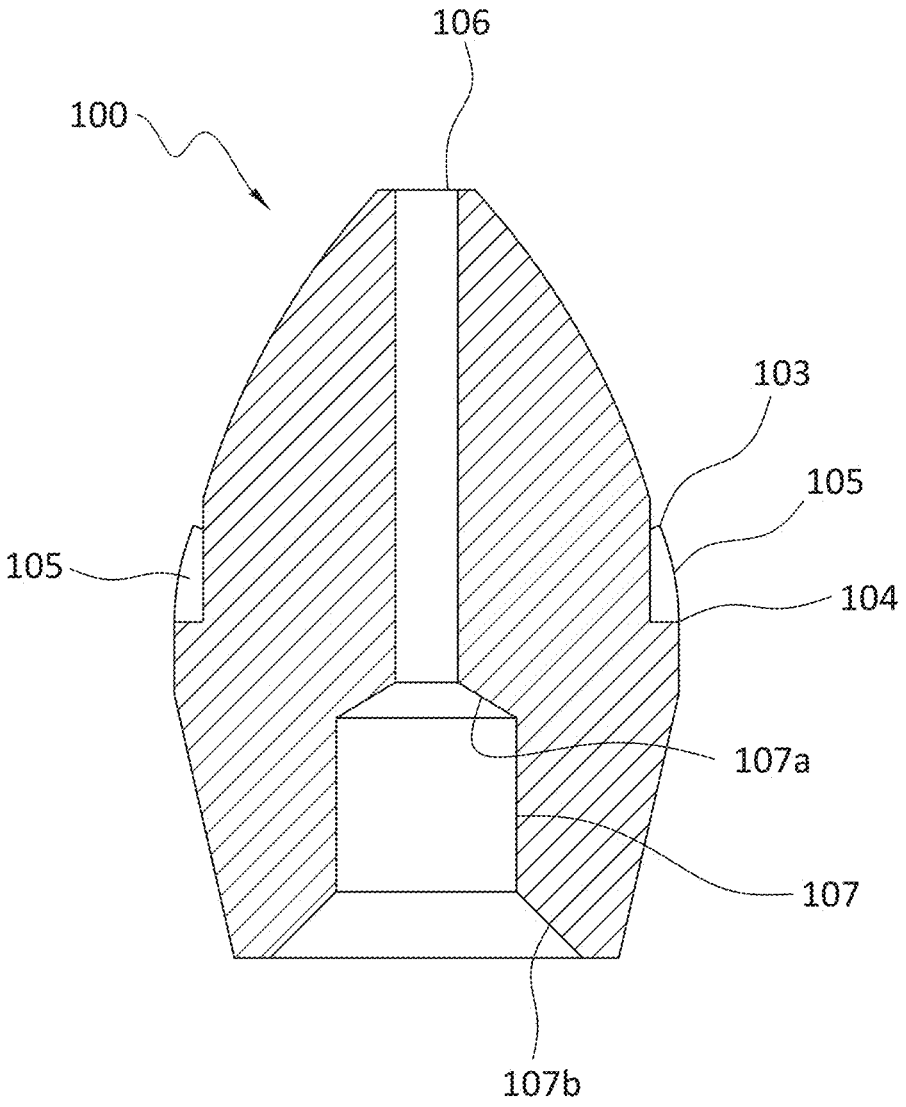
FIG. 6 is a cross-sectional side view of an example KEPR, according to one embodiment.

The example KEPR 100 defines an ignition housing entry port 106 that is open at the top of the body 101 and extends downward into the body 101, as best shown in FIG. 6. The ignition housing entry port 106, which may be concentric with a longitudinal axis of the body 101, communicates with an ignition housing 107. The ignition housing 107 may be sized and configured to receive part of an ignition stack of a non-discarding, grounding sabot.

It is noted that as used herein in the discussion of one or more embodiments, the term 'perforating' refers to the ability of an example KEPR 100 to create holes or openings in a target material, or materials, such as an opening through which fluids, gases, solids, and any combination of these, may flow. Similarly, a 'perforation' refers, in discussions concerning one or more embodiments, to a hole or opening created by a KEPR, regardless of the material(s) in which the hole or opening was created.

An embodiment of the KEPR 100 is configured to perforate or create openings in a well casing and/or other materials, while traveling a minimal distance. For example, in one embodiment, the distance in the barrel of a perforating gun or other apparatus that the KEPR 100 may travel can be less than 2.0" and the confined target standoff distance from the end of the barrel to the target surface may be less than 0.050".

In one embodiment, the KEPR 100 may be a sub-caliber design, that is, the caliber of the KEPR 100 may be smaller than a caliber of a barrel through which the KEPR passes, and may be encased in a non-discarding sabot, examples of which are disclosed in United States Patent Application, entitled GROUNDING SABOT AND METHODS OF USE, and filed the same day herewith (incorporated herein in its entirety by this reference) to maximize velocity and kinetic energy. That is, in an embodiment, the sabot does not discard and remains with the projectile in flight, enabling the sabot to continue to harness and capture energy from the ignited propellant The sabot may, or may not, be utilized to enhance the aerodynamic stability of the KEPR 100 while the KEPR 100 is on its trajectory, or in flight. In an embodiment, the KEPR 100 may be configured for use with specific targets or scenarios involving the creation of openings or perforations in the target material, such as creating a perforation in an oil and gas well casing for the optimization of fluid flow during a frac'ing process.

B.1.2 KEPR Coatings

In order to help facilitate its various functions, a KEPR according to one or more embodiments may comprise one or more coatings that may partly, or completely, coat the KEPR. Following is a discussion of some example coatings that may be employed in one or more embodiments.

In an embodiment, a KEPR may comprise one or more anti-corrosion coatings. Examples include zinc coatings (galvanization) that may be applied through a processes such as galvanization, may provide a protective layer that helps prevent corrosion by acting as a sacrificial barrier. The zinc sacrificially corrodes, protecting the underlying metal. As another example, a KEPR may comprise phosphate conversion coatings that may take the form of a thin, inert layer on the metal surface, that may enhance corrosion resistance.

In an embodiment, a KEPR may comprise one or more heat-resistant coatings. Examples include coatings that may comprise ceramic materials that can withstand high temperatures. Such coatings may be applied to protect components exposed to extreme heat during firing. A KEPR may comprise a coating that includes high-temperature paints that can resist heat and prevent the underlying metal from deteriorating. These coatings may be used on gun barrels and other components subject to intense heat.

In an embodiment, a KEPR may comprise one or more abrasion-resistant coatings. These may include tungsten carbide coatings that provide excellent abrasion resistance due to the hardness of tungsten carbide. These coatings may be used in applications where wear resistance is important. Another example is ceramic matrix composite coatings that use a matrix of ceramic materials embedded in a metal matrix, combining hardness and toughness to resist abrasion. Still another example of abrasion-resistant coatings is hard chrome plating that can enhance surface hardness, reducing wear and improving resistance to abrasion.

In an embodiment, a KEPR may comprise various low-friction coatings. For example, a KEPR may comprise a Teflon® (polytetrafluoroethylene—PTFE) coating to reduce friction and improve wear resistance. PTFE also has non-stick properties. PTFE coatings may be applied to various surfaces on the outside and inside of an embodiment of a KEPR, including the ignition housing and ignition entry port, both of which are discussed elsewhere herein. As another example, a KEPR may comprise a molybdenum disulfide coating to reduce friction between the KEPR and the confined target that the KEPR will be used to perforate. In an embodiment, a KEPR may comprise a graphite coating comprising a solid lubricant. Graphite coatings may be used in combination with other materials or coatings to enhance lubrication and low-friction properties. As another example, a KEPR may comprise a diamond-like carbon (DLC) coatings that may exhibit properties similar to natural diamond, in turn, may provide excellent hardness and low friction. In an embodiment, a KEPR may comprise a polymer-based coating that reduces friction and provide a smooth, low-friction surface. These coatings may include proprietary blends of polymers and solid lubricants.

An embodiment of a KEPR may comprise various nanostructured coatings which, among other things, may lend low-friction properties to coated surfaces of the KEPR. More particularly, such nanostructured coatings may comprise nanoparticles of certain materials, may reduce friction. These coatings may provide a smoother surface at the nanoscale, reducing contact resistance with the target material such as a casing in a wellbore, as well as a confining material such as cement, and a rock formation. one example of such a coating is polyhedral oligomeric silsesquioxane (POSS), the molecules of which may comprise nanosized cage structures containing silicon and oxygen, and may be integrated into polymer matrices to enhance mechanical properties and reduce friction. As another example, nanoparticles of alumina may be used to reinforce coatings, providing hardness and wear resistance. In an embodiment, silica nanoparticles may be incorporated into a KEPR coating to improve hardness and reduce friction. As well, carbon nanotubes may be incorporated into coatings to enhance strength and reduce friction. It is noted that combining different nanoparticles or nanostructured materials may create synergistic effects, leading to coatings with superior properties. For example, a combination of tungsten disulfide and graphite may improve lubrication properties compared to individual materials.

Finally, an embodiment of a KEPR may comprise a tungsten disulfide coating, possibly in the form of a solid lubricant, that may reduce the coefficient of friction between a KEPR and the confined target. Coating a KEPR with tungsten disulfide may reduce friction during perforation.

B.2 Crown

In an embodiment, the crown 102 may comprise a continuous circular arrangement of peaks, slopes, and valleys around the outer diameter of the KEPR 100. In one embodiment, the peaks 103 comprise elevated points, the slopes 105 comprise inclined surfaces, and the valleys 104 comprise depressions or troughs. This configuration may be centered about the mid-section of the KEPR 100 and may extend outward. In operation, the crown 102 may create a perforation in a target material. The diameter of such a perforation may be about the same as a maximum outer diameter of the crown 102.

In an embodiment, the configuration of the crown 102, with its peaks 103, slopes 105, and valleys 104, contributes to reduced friction in the perforation that the KEPR 100 creates. That is, the controlled material deformation, smooth transition through the target, and minimized contact areas help create perforations with smoother inside surfaces, reducing friction when fluids pass through the perforations.

In an embodiment, the perforations generated by the crown 102 may be optimized for fluid flow. The smooth slopes and controlled material displacement contribute to a hole with reduced surface roughness, minimizing resistance and turbulence when fluids are pumped through. This enhances the efficiency of fluid flow through the perforated holes.

In an embodiment, a symmetrical arrangement of peaks 103, slopes 105, and valleys 104 around the outer diameter of the KEPR 100 may help to ensure that the holes created by the KEPR 100 are symmetrical and consistent. Symmetry may be important for applications where precision and uniformity in hole shape and dimensions are required, such as frac'ing a well.

In an embodiment, the crown 102 configuration and arrangement, including the valleys 104, may implement controlled material displacement during the perforation process. This controlled flow of material away from the KEPR 100 may minimize the risk of irregularities or burrs in the perforations, contributing to a more controlled and consistent perforation creation. As well, the crown 102 configuration may prevent material buildup around the outer diameter of the KEPR 100 after the KEPR 100 has been fired. This may be helpful in maintaining consistent contact between the KEPR 100 and the material through which the KEPR 100 passes, possibly reducing the likelihood of uneven forces and ensuring the creation of perforations with optimal shape and quality.

A crown 102 may be implemented using various materials, including tough steel alloys such as tool steel, tungsten carbide, Aermet 100, among others. The ability of the crown 102 to help control the perforation process and create symmetrical, consistent perforations makes the crown 102 a versatile choice for different materials and applications. As well, an embodiment of the crown 102 may reduce the KEPR weight, increasing the velocity of the KEPR improving the perforation and penetration.

As discussed then, an embodiment of the crown 102 may help to optimize the perforation process for creating perforations with reduced friction, enhanced fluid flow characteristics, and optimal symmetry. The controlled material displacement and minimized wear, possibly obtained through use of the crown 102, may contribute to the creation of perforations that meet high precision and quality standards, making the design suitable for a variety of applications. Following is a more detailed discussion of some specific elements of a crown 102.

B.3 Peak

In an embodiment, a peak 103 of the crown 102 comprises the highest point on the crown 102. Among other things, the configuration of the peak 103 may serve to concentrate force at a specific point during a perforation process. This concentration of force helps initiate the penetration of the material and assists in maintaining precision during the process of perforating.

In an embodiment, the peaks 103 are positioned around the outer diameter of the KEPR 100, forming a continuous circular arrangement. Each peak 103 may be situated at the mid-section of the KEPR 100. Thus configured and arranged, the peaks 103 around the outer diameter of the KEPR 100 may provide force concentration. This ensures that force is evenly distributed along the entire perimeter of the KEPR 100. Due to the location, in an embodiment, of the peaks 103 at the mid-section of the KEPR 100, the KEPR 100 has already partially penetrated the target material when the peaks 103 come into contact with that material. This mid-section initiation allows for a controlled and consistent penetration from the midpoint outward.

In an embodiment, the arrangement of the peaks 103 may aid in precision alignment across the entire diameter of the KEPR 100. This may be helpful in creating a uniformly shaped hole as the KEPR 100 progresses through the material. As well, the peaks 103 may serve to minimize the initial contact area between the KEPR 100 and target material(s)

and reduce friction as the KEPR 100 continues to penetrate the target material(s). This configuration may help maintain smooth material flow around the KEPR 100 and minimize resistance during the perforation process.

In an embodiment, the peaks 103 may play a useful role in maintaining symmetry as the KEPR 101 passes through the target material(s). Symmetrical force distribution around the crown 102 circumference may help to ensure that the hole created is consistently circular and squared up. Further, the mid-section initiation of the peaks 103 may enable a controlled deformation of the target material through which the KEPR 100 is passing. This controlled deformation contributes to a smoother transition through the steel alloy, reducing the likelihood of material damage. Finally, the arrangement of peaks 103 may help to ensure that the force applied by the KEPR 100 to the target material(s) is consistently distributed along the entire diameter of the KEPR 100. This consistency may contribute to the creation of a uniformly shaped hole, maintaining accuracy and precision.

B.4 Valleys

A valley 104 is the lower depression or trough in the crown 102, situated between two adjacent peaks 103 and slopes 105. In an embodiment, the valley 104 may serve as a relief area, allowing displaced material to flow away from the KEPR 100 as the KEPR 100 passes through the target material(s). The valley 104 area reduces the overall weight of the KEPR 100, relative to a configuration where the valleys 104 are not present, enabling higher velocities for the KEPR 100. The valleys 104 may also help prevent the KEPR 100 from binding or sticking during a perforating process, contributing to smoother and more efficient perforation.

In an embodiment, the valleys 104 may comprise depressions or troughs that connect the peaks 103 and slopes 105, forming a continuous circular configuration around the outer diameter of the KEPR 100. Each valley 104 may be situated at the mid-section of the KEPR 100 and extend outward. Among other things, the valleys 104 serve as relief areas for the displaced material during the perforating process. As the KEPR 100 progresses through the target material(s), the valleys 104 provide space for the target material displaced by the peaks 103 to flow away from the KEPR 100, preventing interference and binding of the KEPR 100 with the target material(s).

Further, by providing a recessed area, by virtue of their radial depth or thickness, the valleys 104 may help to minimize the contact area between the KEPR 100 and the target material(s). This configuration may reduce friction and the risk of the KEPR 100 binding or sticking during the perforating process. In an embodiment, the valleys 104 may contribute to controlling the flow of displaced material, guiding it away from the KEPR 100 in a controlled manner. This controlled material flow may be helpful in maintaining a smooth and efficient perforating process.

In an embodiment, the valleys 104 may prevent the accumulation of material around the outer diameter of the KEPR 100 as the KEPR 100 passes through the target material(s). This may help to avoid an uneven distribution of forces exerted by the KEPR 100 on the target material(s), and may also help to that the KEPR 100 maintains consistent contact with the target material(s) throughout the perforating operation. By providing a designated space for material displacement, the valleys 104 may contribute to enhanced precision and symmetry in the perforated holes. This controlled material flow helps avoid irregularities and deviations in the hole shape. Finally, the configuration of the valleys 104, in combination with the peaks 103 and slopes 105, may help to optimize the overall quality of the perforated hole, at least in terms of surface finish, dimensional accuracy, and consistency.

B.5 Slopes

A slope 105 refers to the inclined surface connecting a peak 103 to an adjacent valley 104 that may define a lowermost part of the crown 102. In an embodiment, the slope 105 may contribute to the efficient transfer of force from the KEPR 100 to the target material(s). The slope 105 may enable a controlled penetration by the KEPR 100 through the target material(s), reducing the likelihood of fracture or damage to the KEPR 100 while maintaining a smooth perforating action.

In an embodiment, the slopes 105 comprise respective inclined surfaces that connect the peaks 103, forming a continuous circular arrangement around the outer diameter of the KEPR 100. Each slope 105 may be situated at the mid-section of the KEPR 100 and extend outward so that a thickness of the crown 102 is defined. In more detail, the slopes 105 provide a gradual change in elevation from the peaks 103 to the adjacent valleys 104. This configuration may help to ensure a smooth transition and controlled material deformation as the KEPR 100 progresses through the target material(s).

Particularly, the KEPR 100 passes through one or more target materials, the slopes 105 may facilitate the transmission of force from the peaks 103 to the target material(s) being perforated by the KEPR 100. The gradual elevation change embodied in each slope 103 may aid in penetrating the target material(s) with controlled force distribution. Thus, the slopes 105 may contribute to maintenance of control over the perforation process by preventing abrupt changes in force application. This may be helpful in avoiding material damage, fractures, or deviations from the intended path of the KEPR 100.

In an embodiment, the slopes 105 may reduce the contact area between the KEPR 100 and the target material(s), thus possibly minimizing or at least reducing friction. This configuration may help in achieving a smoother perforation process and reduces the risk of the KEPR 100 binding or sticking in the target material(s).

As well, the slopes 105 may play a role in controlling the flow of material displaced by the KEPR 100 as the KEPR 100 passes through the target material(s). By providing a gradual transition, the slopes 105 may guide the material away from the KEPR 100, preventing that material from accumulating and causing interference with the perforating process. Further, the arrangement of slopes 105 around the outer diameter of the KEPR 100 may help to ensure symmetric target material deformation. This may be useful in creating a uniformly shaped hole, aligning with the goal of achieving precision and consistency in the holes. Finally, the slopes 105, in conjunction with the peaks 103, may contribute to maintenance of the size and/or shape of the KEPR along the entire diameter of the KEPR 100. This symmetrical force distribution during perforation aids in creating a hole with consistent shape and dimensions.

B.6 Ignition housing entry port

As shown in FIGS. 1 and 6, an embodiment of the KEPR 100 may comprise an ignition housing entry port, or simply 'entry port,' 106 in the form of a round entry hole that may be designed and machined into the top of the KEPR 100 and travel down to an ignition housing 107. The ignition housing entry port 106 may be configured to enable a physical electrical connection, such as a wire passing through the ignition housing entry port 106, to the ignition device (not shown) that may be stored or encapsulated in the ignition housing 107.

Advantageously, the inclusion of an ignition housing ignition housing entry port 106 may mean that a propellant chamber of a sabot, located below the projectile may omit physical openings other than that holding the KEPR 100, in turn increasing the strength of the systems and reducing the potential failure points within a barrel or a propellant chamber (not shown) that may house the KEPR 100.

In an embodiment, the ignition housing entry port 106 to the ignition housing 107 may comprise a round hole, providing a simple and geometrically sound design. The choice of a round shape is practical for manufacturing and ensures a snug fit for components entering or exiting the port. As well, the diameter of the hole of the ignition housing entry port 106 may be selected based on the size and specifications of the ignition device or communication module that may be housed inside of the ignition housing 107.

To prevent the ingress of moisture, dirt, or other contaminants and debris into the ignition housing 107, a sealing device (not shown), which may be temporary, may be incorporated in an/or around the ignition housing entry port 106. Following are some details concerning one or more embodiments of a sealing device or mechanism.

In an embodiment, a sealing mechanism may comprise epoxy resins, potting compounds, or other similar materials may be utilized for their adhesive and sealing properties for sealing the entry port to the ignition housing 107. These materials may be formulated to resist environmental factors such as moisture, dust, and temperature extremes.

Before applying the chemical sealing material, the surfaces around the entry port need to be properly prepared. This involves cleaning the surfaces to ensure they are free from contaminants that might compromise the adhesion of the sealant. The selected sealing material, whether epoxy resin or another compound, is carefully applied around the ignition housing entry port 106. This can be done manually or through automated processes. In some cases, the ignition housing entry port 106 itself may be partially filled with the sealing compound, or the compound may be applied to the surfaces of the ignition or communication device that will interface with the ignition housing entry port 106. Once applied, the sealing material undergoes a curing process to harden and create a durable seal. The curing time and conditions depend on the specific properties of the chosen material. Some compounds may cure at room temperature, while others may require elevated temperatures. After curing, the integrity of the seal is typically verified through quality control measures. This may involve visual inspections, pressure tests, or other testing methods to ensure that the ignition housing entry port 106 is effectively sealed against environmental ingress.

Various alternatives, or additions, to the sealing material may be employed. For example, in addition to chemical sealing, rubber gaskets or O-rings may be used as supplemental seals. These components are designed to provide a flexible barrier that conforms to irregularities in the mating surfaces, enhancing the overall sealing effectiveness. In some cases, the sealing material can be injected into the ignition housing entry port 106 area using injection molding processes. This allows for a precise and controlled application of the sealant. For electronic components within the ignition or communication device, a conformal coating may be applied. This is a thin protective film that conforms to the contours of the device, providing an additional layer of protection against environmental factors.

In an embodiment where the ignition housing entry port 106 is configured as an entrance or exit into the ignition housing 107 that may house an ignition device, or a device that communicates with it, there may be electrical contacts integrated into the ignition housing entry port 106. These contacts facilitate an electrical connection between the ignition system and the inserted device, allowing for the transmission of power supply, data transfer, and or control signals. In an embodiment, electrical connectors and contacts, examples of which are discussed below, may be incorporated or implemented into the ignition housing ignition housing entry port 106.

For example, an electrical contact may comprise a pin connector including one or more pins made of conductive materials like copper or gold, ensuring good electrical conductivity. In an embodiment, the entry port has corresponding female sockets with spring-loaded contacts to create a secure connection. Particularly, the male pins are inserted into the female sockets, creating an electrical connection. Spring-loaded mechanisms in a pin connector ensure a tight fit, maintaining electrical contact despite vibrations or movements.

An electrical contact may comprise a coaxial connector with a central conductor, insulator, and outer conductor for shielding against EMI (electromagnetic interference). The inner and outer conductors may be made of materials like copper or aluminum. The coaxial connector may be threaded or pushed into an ignition housing entry port, ensuring a secure connection. The shielding prevents EMI from affecting signals/power passing through the electrical contact.

An electrical contact may comprise a circular connector that includes multiple pins arranged in a circular pattern within the connector. The pins may be made of any suitable conductive materials. The circular connector may interact with an ignition housing entry port. In particular, the circular connector may be twisted and/or pushed into the entry port, aligning the pins for contact. A locking mechanism, such as a bayonet mount, may secure the connection.

An electrical contact may comprise a magnetic connector that includes magnets may embedded in the male and female connectors to facilitate self-alignment of the two connectors with each other. The electrical contacts may be made of materials such as gold for good conductivity. With regard to their interaction with an ignition housing entry port, the magnetic connectors attract and self-align. The magnetic force ensures a reliable connection while allowing for easy disconnection.

An electrical contact may comprise a fiber optic connector that uses optical fibers made of glass or plastic for transmitting light signals. The connectors may have ceramic or metal ferrules to align and protect the fiber ends. To interact with an ignition housing entry port, the fiber optic connectors are aligned and inserted into the entry port. Precise alignment ensures efficient light signal transmission.

An electrical contact may comprise a USB connectors. Pins may be made of materials such as copper with gold plating for conductivity. To interact with an ignition housing entry port, USB connectors may be inserted into the entry port, with a distinct design for proper alignment. The connector may feature a locking mechanism for a secure connection.

An electrical contact may comprise pogo pins that use spring-loaded mechanisms for electrical contact. The pins may be made of materials like gold or steel for durability. To interact with an ignition housing entry port, pogo pins may be compressed and inserted into the entry port. The spring-loaded configuration may ensure continuous contact even with minor misalignments.

As a final example, an electrical contact may comprise an insulated wire that includes a conductive core made of copper or aluminum for electrical conduction. Insulation materials such as PVC, Teflon, or rubber protect the conductive core. To interact with an ignition housing entry port, the stripped end of the insulated wire is connected to the entry port. Termination methods such as soldering or crimping may secure the wire in place.

Finally, the ignition housing entry port 106 may have its internal surfaces coated. That coating may be an insulating coating such as PTFE. This coating may serve to insulate any electrical contact, connector, or component from grounding to the KEPR 100.

B.7 Ignition housing

In an embodiment, the ignition housing 107 comprises a round cylindrical shape machined into the KEPR 100 that is larger in inside diameter than the ignition housing entry port 106. The ignition housing 107 may house a portion of an ignition stack and/or ignition device.

In an embodiment, the ignition housing 107 may have a larger inside diameter than the inside diameter of the ignition housing entry port 106, so as to provide sufficient space for various ignition devices. As shown in FIG. 6, the ignition housing 107 may feature a counterbore 107*a*, a recessed area with a larger diameter than the ignition housing entry port 106, providing a well-defined space for receipt of one or more ignition devices. As well, the ignition housing 107 may comprise a counterbore 107*b*.

Among other things, the ignition housing 107 may encapsulate and protect ignition devices within a confined space. The ignition housing 107 may help to ensure that ignition devices are isolated from external environmental factors, including moisture, dust, and temperature fluctuations. Some example ignition devices that may be used in one or more embodiments are discussed below, and may be employed, in some embodiments, as part of an ignition stack.

In an embodiment, an ignition device may comprise a device, such as an ignitor, that ignites the propellant in the propellant chamber. Ignitor plugs are one example embodiment of an ignitor that may be used to initiate the combustion of propellants. Ignitor plugs may comprise a pyrotechnic composition or an electrically heated element. An ignitor may comprise a hot-wire ignitors that may include a resistive wire that heats up rapidly when an electric current passes through it. This heated wire, in turn, ignites the propellant. In still another example, an ignitor may comprise pyrotechnic initiators which may take the form of small devices containing pyrotechnic compositions that generate intense heat or flame when ignited. Such a pyrotechnic initiator may be used to initiate a chain reaction leading to propellant ignition. Various other embodiments of an ignitor are possible as well.

For example, an ignitor may comprise squibs and detonators which are explosive devices that produce a shock-wave or heat capable of igniting propellants. An ignitor may comprise an ignition cartridge that is a self-contained unit that may include both an ignition source and the necessary propellant for initiating combustion. An ignitor may comprise a hypergolic ignition systems. Hypergolic propellants spontaneously ignite upon contact with each other. Hypergolic ignition systems may use this specific property to eliminate the need for a separate ignition device, relying on the inherent reactivity of the propellants. In another embodiment, an ignitor may comprise a laser ignition system that may use a high-energy laser to ignite propellants. In one example, a laser beam is focused on a specific point to initiate combustion of a propellant. As a final example, an ignitor may comprise an electrically ignited initiator that may use electrical current to generate heat or sparks, initiating the combustion of propellants. Such ignitors may include resistive elements or spark-gap designs.

In an embodiment, an ignition device may be chemically bonded to the interior surface of the ignition housing 107 using adhesives. The ignition housing 107 may be configured to align with the ignition housing entry port 106, ensuring a proper fit for the insertion of the ignition device and or communication component or device. Finally, a sealing mechanism or material may be employed between the ignition housing 107 and ignition housing entry port 106 to prevent ingress of foreign matter from the surrounding environment.

C. CASING PORTIONS WITH KEPR-CREATED PERFORATIONS

With attention now to the Appendix (14 pages) filed herewith, and incorporated herein in its entirety by this reference, various photographs are included that disclose aspects of an example KEPR, and perforations created using a KEPR.

In particular, Sheets 1 and 2 disclose aspects of example KEPRS 1-1, and 2-1, respectively. Sheet 3 discloses a perforation 3-1 created with a KEPR in a piece of metal. As shown in the example of Sheet 3, the perforation 3-1 is uniformly circular in shape, and has smooth interior surfaces 3-2 that are generally parallel to a longitudinal axis (extending perpendicular to the surface of the metal) of the perforation 3-1. As well, it can be seen in the example of Sheet 3 that the thickness of the metal around the perforation 3-1 is consistent, indicating that the perforation force exerted by the KEPR was uniformly applied to the metal.

Sheet 4 of the Appendix discloses a metal sample and a concrete fixing agent through which a KEPR has passed, shown by the arrow indicating the path of the KEPR. Sheet 5 of the Appendix indicates another example of a perforation 5-1 made in a metal plate by a KEPR. Similarly, Sheet 6 of the Appendix indicates an example of a perforation 6-1 made in a metal plate by a KEPR. Again, the uniformly circular shape of the perforation 6-1 can be clearly seen.

Next, Sheet 7 of the Appendix discloses an example of a perforation 7-1 made in a metal plate by a KEPR. In the example of Sheet 7, the 'scalloping' 7-2 created by the crown of a KEPR can be clearly seen. In this example, peaks 7-3 and valleys 7-4 have been created that correspond to peaks and valleys of an embodiment of KEPR.

Sheets 8, 9, 10, and 11 disclose further examples of metal plates of various thicknesses. A perforation created by a KEPR can be seen in each of those examples. In each case, the cleanliness and symmetry of the perforations can clearly be seen.

Finally, Sheets 12-14 of the Appendix disclose some data obtained from test firings of various KEPRs. It is note that an embodiment of a KEPR is able to create a consistent hole geometry that is not possible with shape charge, sometimes referred to as 'jet shot,' perforating devices. Conventional jet shot holes at best can only achieve diameter variations of +/−3% (standard deviation), while KEPRs reduce this variation by an order of magnitude, approaching near-zero variation.

The test results disclosed in the Appendix were obtained using a test fixture with targets made up of pipe samples and concrete. The actual KEPR performance data is shown in Sheets 13-15. In particular, the KEPRs were fired into the target under pressure, and the geometry of the holes in the pipe, along with the penetration of the bullets into the concrete, was measured. The KEPR hole diameter in the pipe was accurately measured using a high-resolution 3-point bore-gauge at four different positions. These measurements were reported at the minimum and maximum diameter axes. The variation in the average hole diameter was determined to be less than 0.5% and, in some cases, dropped below 0.1%. The test fixture shots also confirmed adequate penetration into the concrete of over 5 inches. The data further documents the consistency of the hole geometry with the small observed variations in the maximum and minimum diameter measurements.

D. FURTHER EXAMPLE EMBODIMENTS

Following are some further example embodiments. These are presented only by way of example and are not intended to limit the scope of this disclosure, or of the claims, in any way.

Embodiment 1. A kinetic energy perforating round, comprising: a body defining an ignition housing entry port and ignition housing that are in communication with each other; and a crown configuration disposed circumferentially about an outside diameter of the body.

Embodiment 2. The kinetic energy perforating round as recited in any preceding embodiment, wherein the crown configuration defines a maximum outside diameter of the kinetic energy perforating round.

Embodiment 3. The kinetic energy perforating round as recited in any preceding embodiment, wherein the crown configuration is integral with the body so that the kinetic energy perforating round has a unified, single-piece, construction.

Embodiment 4. The kinetic energy perforating round as recited in any preceding embodiment, wherein an upper portion of the body has a generally conical configuration, a lower portion of the body has a truncated conical configuration, and a middle portion of the body bulges outward beyond the upper portion and the lower portion.

Embodiment 5. The kinetic energy perforating round as recited in any preceding embodiment, wherein the crown configuration comprises a plurality of peaks spaced apart from each other and distributed circumferentially about the body, and the peaks are oriented toward a tip of the body.

Embodiment 6. The kinetic energy perforating round as recited in any preceding embodiment, wherein the crown configuration comprises a plurality of slopes disposed circumferentially about the body.

Embodiment 7. The kinetic energy perforating round as recited in any preceding embodiment, wherein the crown configuration comprises a plurality of valleys spaced apart from each other and circumferentially about the body.

Embodiment 8. The kinetic energy perforating round as recited in any preceding embodiment, wherein a radial thickness of the crown configuration at a peak of the crown configuration is less than a radial thickness of the crown configuration at a valley of the crown configuration.

Embodiment 9. The kinetic energy perforating round as recited in any preceding embodiment, wherein the crown configuration is such that a valley of the crown configuration is positioned, circumferentially, between each two peaks of the crown configuration.

Embodiment 10. The kinetic energy perforating round as recited in any preceding embodiment, wherein the ignition housing entry port is sealed.

Embodiment 11. The kinetic energy perforating round as recited in any preceding embodiment, wherein part of the body is coated with a low-friction coating.

Embodiment 12. The kinetic energy perforating round as recited in any preceding embodiment, wherein the crown configuration comprises peaks which, in use: create a circumferential alignment of the KEPR when perforating; minimize an initial contact area between the KEPR and a target material; and/or, symmetrically distribute a force exerted by the kinetic energy perforating round about a circumference of the kinetic energy perforating round.

Embodiment 13. The kinetic energy perforating round as recited any preceding embodiment, wherein the crown configuration comprises slopes which, in use: control a flow of target material displaced by the kinetic energy perforating round as it passes through a target; and/or, help to ensure symmetry in deformation of the target material through which the kinetic energy perforating round at least partially passes.

Embodiment 14. The kinetic energy perforating round as recited in any preceding embodiment, wherein the crown configuration comprises a plurality of valleys which, in use: displace target material as the kinetic energy perforating round passes into a target; and/or, reduce friction between the kinetic energy perforating round and material of the target.

Embodiment 15. A method for using a kinetic energy perforating round in a downhole operation, comprising: firing a kinetic energy perforating round at a target; and by the kinetic energy perforating round: symmetrically distributing about a circumference of the kinetic energy perforating round, and exerting on the target, a force created by the firing; displacing target material as the kinetic energy perforating round passes into the target; and/or, controlling a flow of the target material displaced by the kinetic energy perforating round as the kinetic energy perforating round passes through the target.

Embodiment 16. The method as recited in embodiment 15, wherein the target comprises any one or more of a well casing, cement, and/or a geological formation.

Embodiment 17. The method as recited in any of embodiments 15-16, wherein the kinetic energy perforating round is fired from a barrel whose end is less than 0.050 inches from the target.

Embodiment 18. The method as recited in any of embodiments 15-17, wherein the kinetic energy perforating round is fired from a barrel, and a distance traveled by the kinetic energy perforating round in the barrel is less than 2.0 inches.

Embodiment 19. The method as recited in any of embodiments 15-18, wherein the firing comprises passing an electrical current through a body of the kinetic energy perforating round to ignite a propellant and create the force by ignition of the propellant.

Embodiment 20. The method as recited in any of embodiments 15-19, wherein the kinetic energy perforating round is fired from a perforating gun as part of a frac'ing process.

Embodiment 21. A section of well casing, comprising: a body made of metal; and a perforation in the body, wherein the perforation was created with a KEPR, and the perforation is circular and symmetric.

The described embodiments are to be considered in all respects only as illustrative and not restrictive. All changes which come within the meaning and range of equivalency of the claims are to be embraced within their scope.

What is claimed is:

1. A kinetic energy perforating round comprising:

a body defining an ignition housing entry port and ignition housing that are in communication with each other; and a crown configuration disposed circumferentially about an outside diameter of the body, wherein an upper portion of the body has a generally conical configuration, a lower portion of the body has a truncated conical configuration, and a middle portion of the body bulges outward beyond the upper portion and the lower portion.

2. A kinetic energy perforating round comprising:

a body defining an ignition housing entry port and ignition housing that are in communication with each other; and a crown configuration disposed circumferentially about an outside diameter of the body, wherein the crown configuration comprises a plurality of peaks spaced apart from each other and distributed circumferentially about the body, and the peaks are oriented toward a tip of the body.

3. A kinetic energy perforating round comprising:

a body defining an ignition housing entry port and ignition housing that are in communication with each other; and a crown configuration disposed circumferentially about an outside diameter of the body, wherein the crown configuration comprises a plurality of slopes disposed circumferentially about the body.

4. A kinetic energy perforating round comprising:

a body defining an ignition housing entry port and ignition housing that are in communication with each other; and a crown configuration disposed circumferentially about an outside diameter of the body, wherein the crown configuration comprises a plurality of valleys spaced apart from each other and circumferentially about the body.

5. A kinetic energy perforating round comprising:

a body defining an ignition housing entry port and ignition housing that are in communication with each other; and a crown configuration disposed circumferentially about an outside diameter of the body, wherein the crown configuration comprises peaks which, in use:

create a circumferential alignment of the kinetic energy perforating round when perforating;

minimize an initial contact area between the kinetic energy perforating round and a target material; and/or symmetrically distribute a force exerted by the kinetic energy perforating round about a circumference of the kinetic energy perforating round.

6. A kinetic energy perforating round comprising:

a body defining an ignition housing entry port and ignition housing that are in communication with each other; and a crown configuration disposed circumferentially about an outside diameter of the body, wherein the crown configuration comprises slopes which, in use:

control a flow of target material displaced by the kinetic energy perforating round as it passes through a target; and/or help to ensure symmetry in deformation of the target material through which the kinetic energy perforating round at least partially passes.

7. A kinetic energy perforating round comprising:

a body defining an ignition housing entry port and ignition housing that are in communication with each other; and a crown configuration disposed circumferentially about an outside diameter of the body, wherein the crown configuration comprises a plurality of valleys which, in use:

displace target material as the kinetic energy perforating round passes into a target; and/or reduce friction between the kinetic energy perforating round and material of the target.

* * * * *